US011446942B2

(12) United States Patent
Forcada Pardo et al.

(10) Patent No.: US 11,446,942 B2
(45) Date of Patent: Sep. 20, 2022

(54) PRINT HEAD MAINTENANCE ASSEMBLY

(71) Applicant: Hewlett-Packard Development Company, L.P., Spring, TX (US)

(72) Inventors: Santiago Forcada Pardo, Sant Cugat del Valles (ES); Sheila Cabello Cabrera, Sant Cugat del Valles (ES); Jorge Millan Lafuente, Sant Cugat del Valles (ES); Jeffrey Thielman, Sant Cugat del Valles (ES); Andreu Cortes Vicens, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/259,576

(22) PCT Filed: Dec. 7, 2018

(86) PCT No.: PCT/US2018/064558
§ 371 (c)(1),
(2) Date: Jan. 12, 2021

(87) PCT Pub. No.: WO2020/117273
PCT Pub. Date: Jun. 11, 2020

(65) Prior Publication Data
US 2021/0268817 A1 Sep. 2, 2021

(51) Int. Cl.
*B41J 2/17* (2006.01)
*B41J 29/17* (2006.01)
*B41J 2/165* (2006.01)

(52) U.S. Cl.
CPC ..... *B41J 29/17* (2013.01); *B41J 2/16579* (2013.01)

(58) Field of Classification Search
CPC ..... B41J 29/17; B41J 2/16579
See application file for complete search history.

(56) References Cited

U.S. PATENT DOCUMENTS

| | | | |
|---|---|---|---|
| 5,574,484 | A | 11/1996 | Cowger |
| 6,164,753 | A | 12/2000 | Maza et al. |
| 6,179,401 | B1 | 1/2001 | Stephens et al. |
| 6,390,587 | B1 | 5/2002 | Subirada |
| 6,467,867 | B1 | 10/2002 | Worthington et al. |
| 6,513,904 | B1 | 2/2003 | Taylor et al. |
| 6,520,619 | B1 | 2/2003 | Murcia et al. |
| 6,568,787 | B1 | 5/2003 | Girones et al. |
| 6,637,853 | B1 | 10/2003 | Ahne et al. |

(Continued)

FOREIGN PATENT DOCUMENTS

| | | | |
|---|---|---|---|
| EP | 0718104 A1 * | 6/1996 | ..... B41J 2/17566 |
| EP | 0997896 | 5/2000 | |

(Continued)

*Primary Examiner* — Sharon Polk
(74) *Attorney, Agent, or Firm* — HP Inc. Patent Department

(57) ABSTRACT

Disclosed herein is a print head maintenance assembly, a printing device and a method of controlling a print head maintenance assembly in a printing device. The print head maintenance assembly comprises a maintenance cartridge comprising a positioning flag, wherein the maintenance cartridge is movable along a maintenance path in a direction of movement; and a sensor to detect the positioning flag to determine the position of the maintenance cartridge along the maintenance path.

19 Claims, 8 Drawing Sheets

(56) References Cited

U.S. PATENT DOCUMENTS

| | | | | |
|---|---|---|---|---|
| 9,862,194 | B2 | 1/2018 | Llado et al. | |
| 2009/0151583 | A1 | 6/2009 | Dangelewicz et al. | |
| 2010/0214597 | A1 * | 8/2010 | Hasseler | B41J 29/38 358/1.15 |

FOREIGN PATENT DOCUMENTS

| | | | | |
|---|---|---|---|---|
| EP | 1241011 | A2 * | 9/2002 | B41J 2/17546 |
| JP | 2019119137 | A * | 7/2019 | |

* cited by examiner

PRINT HEAD MAINTENANCE ASSEMBLY

BACKGROUND

Printing devices like ink-jet printers may have to be cleaned regularly in order to prevent a deterioration of image quality e.g. due to partial or complete clogging of print head nozzles. To this end, printing devices can comprise a maintenance subsystem, which performs cleaning operations on a print head of the printing device.

BRIEF DESCRIPTION OF DRAWINGS

In the following, a detailed description of various examples is given with reference to the figures. The figures show schematic illustrations of FIG. 1*a*: a print head maintenance assembly in accordance with an example in top view.

DETAILED DESCRIPTION

To clean a print head, a printing device can comprise a maintenance cartridge with a number of subsystems for performing cleaning operations, for example a wiping subsystem to wipe off contaminants like dried ink or paper fibers from the print head and a spittoon subsystem, into which material can be ejected from the print head nozzles. When performing the cleaning, the maintenance cartridge may be positioned adjacent to the print head, based on a known position of the maintenance cartridge. The position of the maintenance cartridge may be determined when the printing device is switched on, e.g. after the printing device had been switched off, or after a crash or after the maintenance cartridge has been moved manually so that the maintenance cartridge may be in an unexpected position.

Figure 1A:
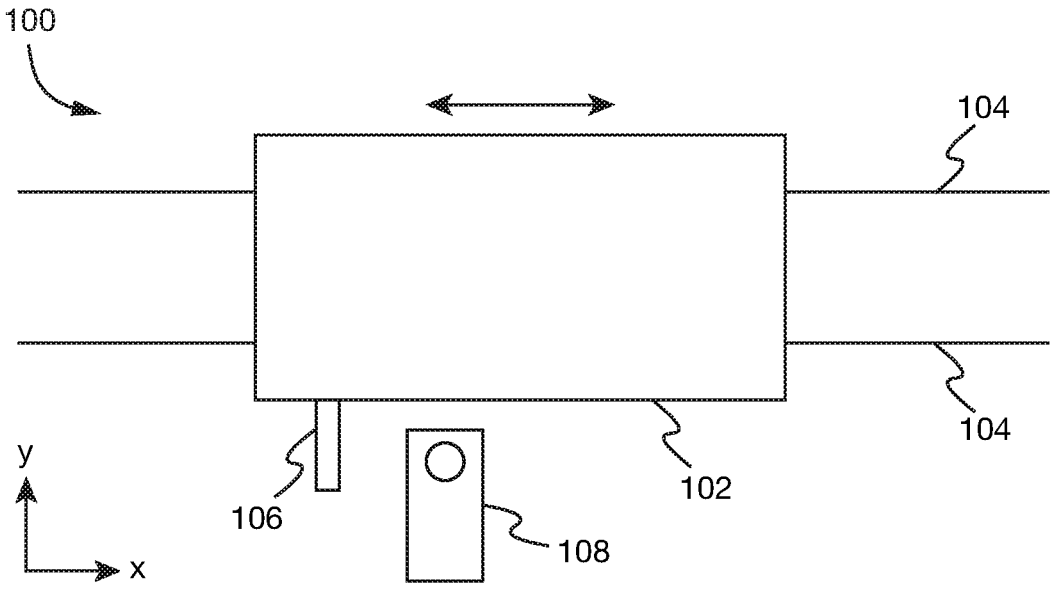
FIG. 1*b*: the print head maintenance assembly of FIG. 1*a* in front view.

FIG. 1*a* depicts a top view of an example of a print head maintenance assembly 100. The print head maintenance assembly 100 may for example be employed in a printing device to clean a print head of the printing device (not shown in FIG. 1*a*). The print head maintenance assembly 100 comprises a maintenance cartridge 102, which may comprise subsystems like a wiping sub-system or a spittoon subsystem. The maintenance cartridge 102 can be moved along a maintenance path 104 in a direction of movement, e.g. to clean a print head positioned above the maintenance cartridge 102 in the direction of view in FIG. 1*a*.

In FIG. 1*a*, the direction of movement of the maintenance cartridge 102 is indicated by the double-headed arrow above the maintenance cartridge. The direction of movement is aligned with the X-axis in FIG. 1*a* and is denoted as the X-direction in the following. In one example, the print head maintenance assembly 100 may be used in a printing device. In this example, the X-direction may e.g. be a horizontal direction perpendicular to a scanning direction along which a print head of the printing device moves to traverse a print zone, as explained further below. The scanning direction may e.g. be aligned with the Y-axis in FIG. 1*a* and is denoted as the Y-direction in the following. The direction perpendicular to the X-direction and the Y-direction, which may e.g. be a vertical direction in a printing device, is denoted as the Z-direction in the following.

The maintenance cartridge 102 comprises a positioning flag 106 that is to be detected by a sensor 108 to determine the position of the maintenance cartridge 102 along the maintenance path 104. The sensor 108 can for example be a proximity sensor that senses the presence or absence of the positioning flag 106 in the vicinity of the sensor 108 or a distance sensor that determines a distance between the sensor 108 and the positioning flag 106. The sensor 108 may be fixed to one position, e.g. integrated in or attached to a frame or chassis of a printing device.

The sensor 108 may for example be an optical sensor, e.g. a photoelectric sensor to be triggered by the positioning flag 106 as described in more detail below with reference to FIG. 1*b* or an optical distance sensor, e.g. a laser rangefinder, which measures the distance between the sensor 108 and the positioning flag 106. The positioning flag 106 may for example be a spatial surface feature arranged on an outer surface of the maintenance cartridge 102, e.g. a protrusion extending outwards from a side face of the maintenance cartridge 102. Alternatively or additionally, the positioning flag 106 may exhibit optical properties distinguishing the positioning flag 106 from adjacent parts of the maintenance cartridge 102, e.g. an enhanced or reduced absorption or reflectivity for light emitted by the sensor 108, a different color or different reflection properties, e.g. a roughened or patterned surface for scattering reflected light.

In one example, the sensor 108 may be an electric or magnetic sensor, e.g. a capacitive sensor, an inductive sensor or a Hall effect sensor. In this case, the positioning flag 106 may for example be a plastic, metallic or magnetic structure arranged on or embedded in the maintenance cartridge 102, e.g. a magnet attached to a side face of the maintenance cartridge 102 to be detected by an inductive element in the sensor 108. In another example, the sensor 108 may be a contact sensor, e.g. a mechanical or electric contact sensor, that detects when the positioning flag 106 comes in contact with the sensor 108.

Figure 1B:
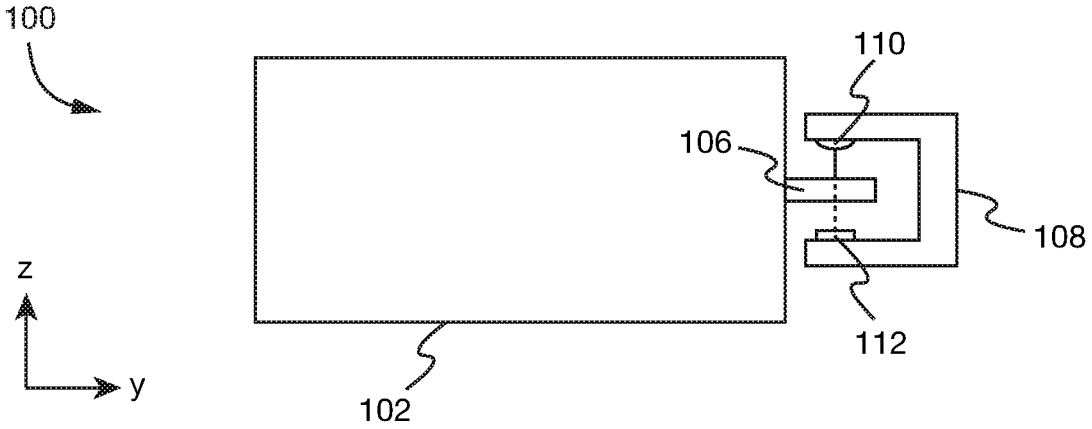

FIG. 1*b* shows a front view of the print head maintenance assembly 100. In this example, the positioning flag 106 is an arm-like protrusion extending from a side face of the maintenance cartridge 102. The sensor 108 is a photoelectric sensor comprising two support legs carrying sensor elements, wherein the legs may be part of a "U"-shaped body, which is arranged such that the positioning flag 106 passes between the opposite upper and lower legs of the body when the maintenance cartridge 102 moves past the sensor 106. A light source 110 and an optical sensor element 112 are arranged on two opposing inner surfaces of the legs such that the optical sensor element 112 faces the light source 110.

The light source 110 may for example be a light-emitting diode or a laser source, which emits light in the direction of the optical sensor element 112. The optical sensor element may e.g. be a photodiode to measure a light intensity. Alternatively, a light source 110 and an optical sensor element 112 may be arranged at opposite surfaces of any other structure, including parts of the printer frame or chassis. In another example, the sensor 108 can be a diffuse or retro-reflective photoelectric sensor, wherein the light source 110 and the optical sensor element 112 may be arranged adjacent to each other, e.g. on the same surface, and a reflective element may e.g. be arranged on an opposing surface.

When the maintenance cartridge 102 is positioned such that the positioning element 106 is in between the light source 110 and the optical sensor element 112, the positioning flag 106 blocks the direct line-of-sight between the light source 110 and the optical sensor element 112. Therefore, the light intensity measured by the optical sensor element 112 may be reduced compared to a situation, in which the positioning element 106 is outside of the sensor 108. Accordingly, a sensor signal from the sensor 108 that characterizes the measured intensity on the optical sensor element 112 may be used to determine, when the maintenance cartridge 102 is in a position, in which the positioning element 106 is in between the light source 110 and the optical sensor element 112. This position is referred to as a reference position in the following. Whenever the maintenance cartridge 102 passes by the reference position, the sensor 108 is triggered by the positioning element 106.

Figure 2A:
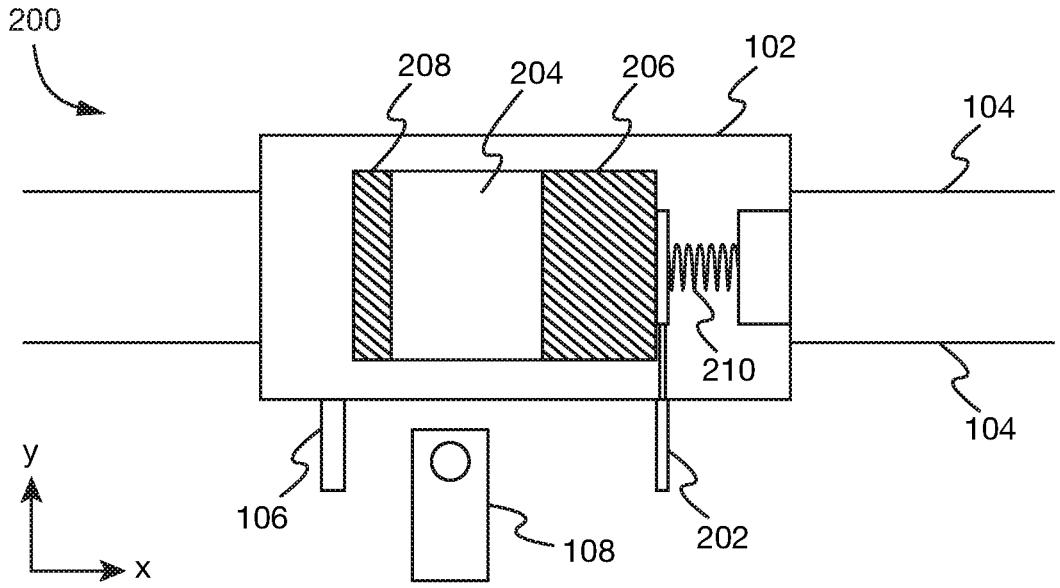
FIG. 2*a*: a print head maintenance assembly with a status flag in accordance with an example in top view.
Figure 2B:
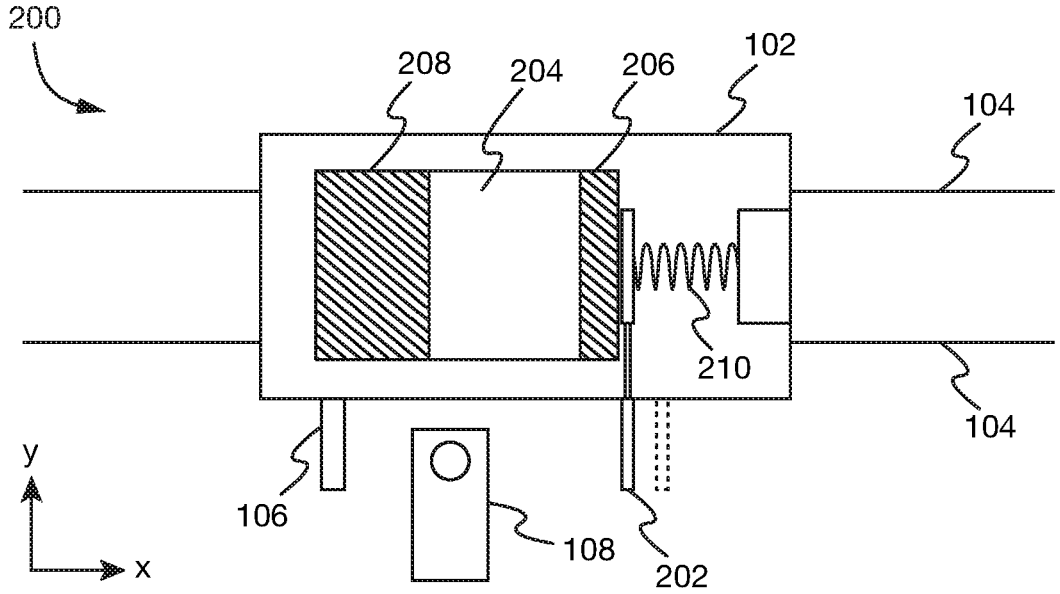
FIG. 2*b*: an adjustment of the status flag of the print head maintenance assembly of FIG. 2*a* in accordance with an example.

FIGS. 2*a* and 2*b* illustrate another example of a print head maintenance assembly 200 in top view. Similar to the print head maintenance assembly 100, the print head maintenance assembly 200 comprises a maintenance cartridge 102, which is movable along a maintenance path 104 and comprises a positioning flag 106, and a sensor 108 to detect the positioning flag 106 as described above. In addition, the maintenance cartridge 102 comprises a status flag 202, which indicates a status parameter of the maintenance cartridge 102. The status parameter may for example describe a status of the maintenance cartridge 102 or one of its subsystems, e.g. a filling level of a waste tank, a usage status of a wiper or whether the maintenance cartridge 102 is operational or needs servicing. The status flag 202 may indicate the status parameter in a quantitative way, i.e. may indicate the value of the status parameter, or may indicate the status parameter in a binary on-off fashion, e.g. may indicate if the status parameter is above or below a certain threshold value. The status flag 202 may be similar to the positioning flag 106 as described above, e.g. a protrusion on a side face of the maintenance cartridge 102 or an arm extending from a side face of the maintenance cartridge 102. The status flag 202 also may be a changing color or brightness of a particular area at the side face of the maintenance cartridge, for example. The sensor 108 is to detect the status flag 202 to determine the status parameter of the maintenance cartridge 102.

In the example shown in FIGS. 2*a* and 2*b*, the maintenance cartridge 102 comprises a wiping material such as a web wipe 204 for wiping a print head. A clean part of the web wipe 204 is rolled up on a clean web roll 206, whereas a dirty part that has already been used for wiping is rolled up on a dirty web roll 208. The position of the status flag 202 on the maintenance cartridge 102 along the X-direction indicates a usage status of the web wipe 204, e.g. the amount of web wipe 204 rolled up on the clean web roll 206. For this, an end portion of the status flag 202 can be pressed against the web wipe 204 on the clean web roll 206 by a spring 210. Correspondingly, when the web wipe 204 is unrolled from the clean web roll 206, the diameter of the clean web roll 206 decreases and the status flag 202 moves to the left as illustrated in FIG. 2*b*. The dashed line in FIG. 2*b* illustrates the position of the status flag 202 in the situation depicted in FIG. 2*a*, in which the majority of the web wipe is on the clean web roll 206 and the status flag 202 is hence farther to the right. The spring 210 may further be used to generate a brake force for the web wipe 204 by pressing against the web wipe 204, e.g. to create a tension within the web wipe 204. The amount of clean web wipe remaining may thus be determined by determining the position of the status flag 202 relative to the positioning flag 106 as described in detail below with reference to FIG. 8. In other examples, the status flag 202 may be mechanically coupled to the clean web roll 206 or the dirty web roll 208, e.g. via a gear drive, such that the status flag 202 is moved whenever the respective web roll is rotated. In yet another example, the status flag 202 may be moved by an actuator, e.g. by a certain distance each time a wiping operation is performed.

Figure 3A:
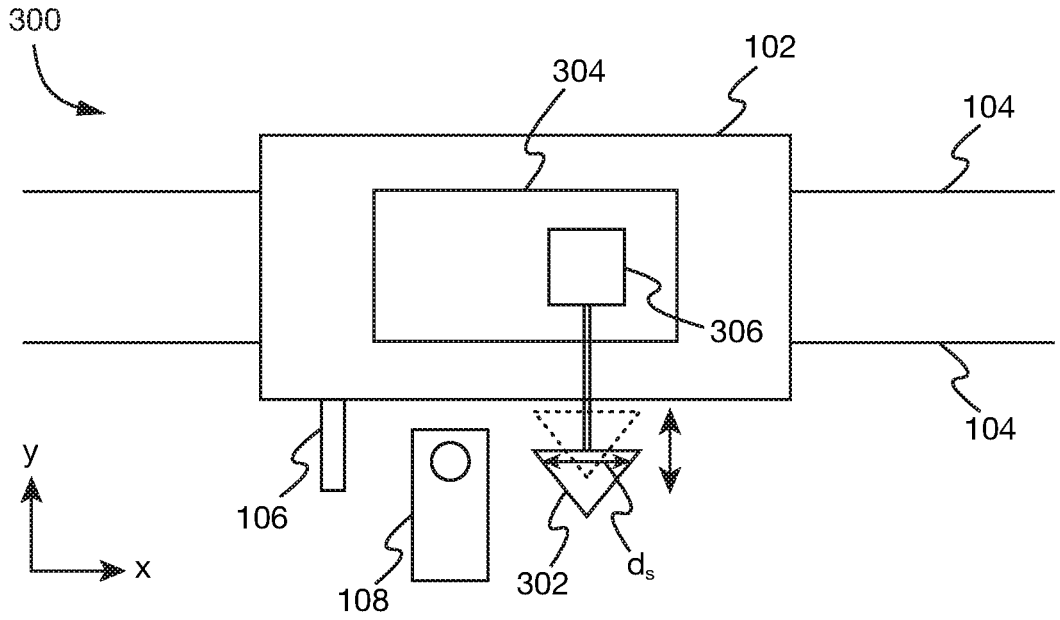
FIG. 3*a*: another print head maintenance assembly with a status flag in accordance with an example in top view.
Figure 3B:
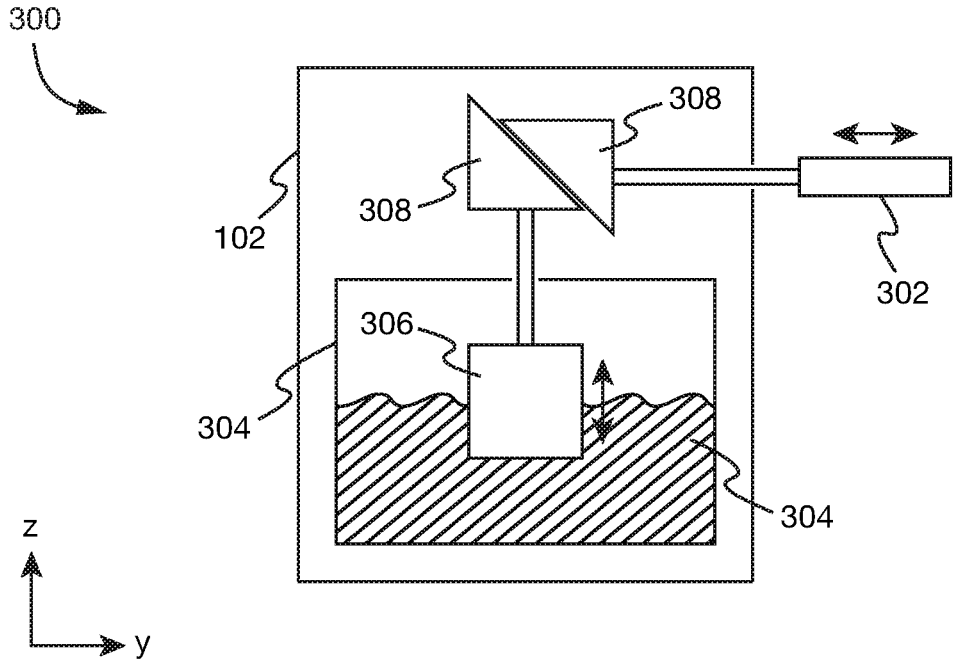
FIG. 3*b*: an adjustment of the status flag of the print head maintenance assembly of FIG. 3*a* in accordance with an example in a sectional view.

FIGS. 3*a* and 3*b* illustrate another example of a print head maintenance assembly 300 in top view and in a sectional view, respectively. Similar to the print head maintenance assembly 200, the print head maintenance assembly 300 comprises a maintenance cartridge 102, which is movable along a maintenance path 104 and comprises a positioning flag 106, and a sensor 108 to detect the positioning flag 106 as described above. The maintenance cartridge 102 also comprises a status flag 302, which indicates a status parameter of the maintenance cartridge 102. Unlike for the status flag 202 in FIGS. 2*a* and 2*b*, however, the status parameter is not encoded in the position of the status flag 302 along the length of the maintenance cartridge 102 in the X direction, but in a visible length $d_s$ of the status flag 302, wherein the visible length $d_s$ is the width of the status flag 302 in the X-direction at a measurement position of the sensor 108 along the Y-direction of the maintenance cartridge, e.g. the position of the optical sensor element 112 along the Y-direction. If the sensor 108 is a photoelectric sensor as described above, the visible length $d_s$ is the distance over which the maintenance cartridge 102 blocks the light source 110, between the first and last points at which the status flag 302 passes through the sensor 108.

The visible length of the status flag 302 is increased or decreased whenever the respective status parameter changes. For example, if the status flag 302 has a triangular shape in top view as shown in FIG. 3*a*, the visible length $d_s$ may be changed by moving the status flag 302 away from or closer to the maintenance cartridge, i.e. along the Y-direction in the example of FIG. 3*a*. The sensor 108 is to detect the visible length $d_s$ of the status flag 302 to determine the status parameter of the maintenance cartridge 102 as detailed below with reference to FIG. 8.

In the print head maintenance assembly 300, the maintenance cartridge 102 further comprises a waste tank or spittoon 304 to receive material ejected from a print head. The material ejected from the print head may e.g. consist of or comprise a printing fluid such as ink. The status flag 302 of this example indicates a status parameter characterizing a filling level of the spittoon 304. For this, a floater 306 may be movably arranged in the maintenance cartridge 102, wherein a position of the floater 306 depends on the filling level of the spittoon 304. The floater 306 may be coupled to the status flag 306 such that status flag 306 is moved whenever the position of the floater 306 changes. In one example, the floater 306 may be placed in the spittoon 304 to float on the material contained in the spittoon 304 as illustrated in FIG. 3*b*. Accordingly, the floater 306 can move up and down, e.g. along the Z-direction as illustrated by the vertical arrow in FIG. 3*b*, when the filling level of the spittoon 304 changes. The floater 306 may e.g. be mechanically coupled to the status flag 302 such that, when the floater 306 moves along the Z-direction, the status flag 302 moves in the Y-direction as illustrated by the horizontal arrow in FIG. 3*b*. For this, the floater 306 and the status flag 302 may for example be coupled by two coupling elements 308 which are in contact with each other via two opposing surfaces that are tilted with respect to the Y-direction and the Z-direction as shown in FIG. 3*b*. If the floater 306 is constrained along the Y-direction, e.g. by a wall of the spittoon 304, and the status flag 302 is constrained along the Z-direction, e.g. by a side wall of the maintenance cartridge 102, the coupling elements 308 can translate a movement of the floater 306 along the Z-direction into a movement of the status flag 302 in the Y-direction. In another example, the floater 306 and the status flag 302 may be connected directly via a rod or via a rotatable coupling element that is pivotally hinged at a wall of the spittoon 304.

In one example, the status flag 302 may be moved along the Z-direction, e.g. by directly connecting the status flag 302 to the floater 306 and restricting its movement in the Y-direction, while allowing the movement in the Z-direction. To determine the status parameter, the sensor 108 may determine the position of the status flag 302 in the Z-direction. For this, the status flag 302 may e.g. be a magnetic element and the sensor 108 may be a magnetic sensor capable of determining the minimum distance to the status flag 302 that occurs as the status flag 302 is moved past the sensor 108, from which the position of the status flag 302 in the Z-direction may be extracted. Alternatively, the sensor 108 may be an optical sensor capable of directly measuring the position of the status flag 302 in the Z-direction. The optical sensor element 112 may for example be placed adjacent to the light source 110 to determine the time-of-flight of light emitted by the light source and reflected off the status flag 302.

In other examples, a status flag may indicate a status of the maintenance cartridge 102 in a binary on-off fashion. The status flag 302 may e.g. be arranged inside the maintenance cartridge 102 when the filling level of the spittoon 304 is below a predefined threshold level and may be moved out of the maintenance cartridge 302 when the filling level exceeds the predefined threshold level. The sensor 108 may detect the presence or absence of the status flag 302 outside of the maintenance cartridge 102 to determine whether the spittoon 304 is full and requires servicing. Similarly, the status flag 202 may be arranged inside the maintenance cartridge 102 when the amount of web wipe 204 on the clean web roll 206 is above a predefined threshold amount and may be moved out of the maintenance cartridge 102 when the amount of web wipe 204 on the clean web roll 206 drops below the predefined threshold amount. In another example, the maintenance cartridge 102 may comprise a status flag indicating whether the maintenance cartridge 102 is operational, e.g. a status flag whose presence outside of the maintenance cartridge 102 indicates that the maintenance cartridge 102 has to be serviced.

Figure 4:
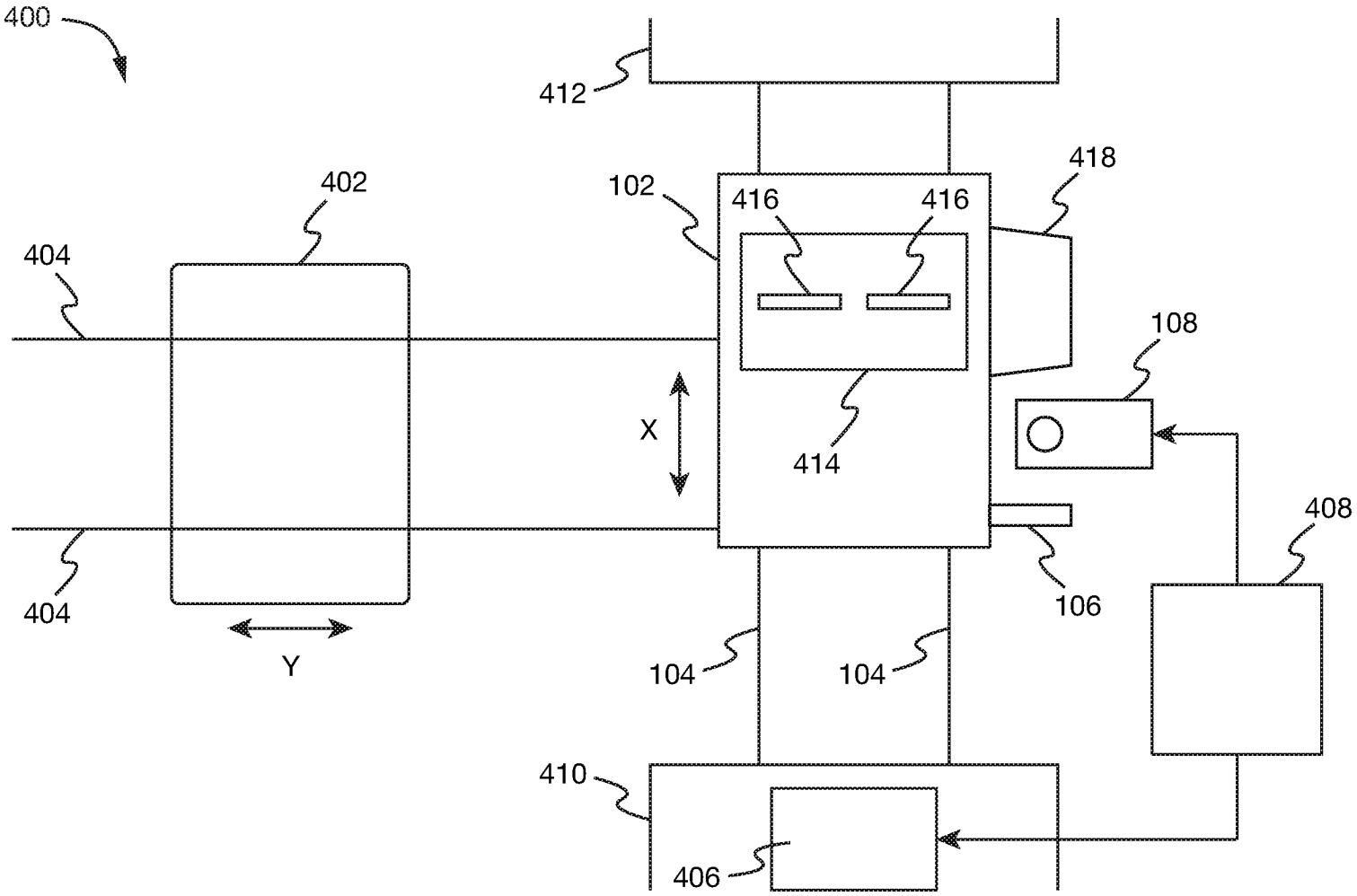
FIG. 4: a printing device according to an example in top view.

FIG. 4 shows a top view of a printing device 400 according to an example. The printing device 400 comprises a print head 402, e.g. an ink-jet print head having a reservoir for a printing fluid such as ink and a nozzle plate for depositing the printing fluid on a print medium. The print head 402 is movable along a print head path 404 in a scanning direction, illustrated by the arrow labeled "Y" in FIG. 3 and denoted as the Y-direction in the following, which may e.g. be perpendicular to a direction of movement of the print medium, also referred to as media advance direction. The media advance direction may be aligned with the X-direction. The printing device 400 may comprise an actuator for moving the print head along the print head path 404, for example an electric motor coupled to a carriage carrying the print head via a drive belt or a gear drive such as a worm drive.

The printing device 400 comprises a maintenance cartridge 102, which is movable along a maintenance path 104 and comprises a positioning flag 106, and a sensor 108 to detect the positioning flag 106 as described above. The maintenance path 104 may e.g. be aligned with the X-direction, as illustrated by the arrow labeled "X", to traverse the print head path 404. To move the maintenance cartridge 102, the printing device 400 further comprises an actuator 406, e.g. an electric motor coupled to the maintenance cartridge 102 via a drive belt or a gear drive such as a worm drive.

The printing device 400 also comprises a controller 408 to control the actuator 406, e.g. by sending drive commands to the actuator 406 or by providing a suitable electric drive signal, e.g. a pulse-width modulated drive voltage. Furthermore, the controller 408 reads out a sensor signal from the sensor 108, e.g. an electric voltage or digital signal quantifying the light intensity measured by the optical sensor element 112 or an analog or digital signal characterizing a distance measured by the sensor 108. The controller 408 determines the position of the maintenance cartridge 102 from the sensor signal, e.g. by detecting when the sensor 108 is triggered as described in more detail below with reference to FIG. 7.

The controller 408 may further track the position of the maintenance cartridge 102 by determining a distance that the maintenance cartridge 102 moves after the controller 408 determined the position of the maintenance cartridge 102 from the sensor signal. If the sensor 108 is capable of measuring a distance to the positioning flag 106, the controller 408 may track the position of the maintenance cartridge 102 by repeatedly reading out the sensor signal. Alternatively, the controller 408 may track the position of the maintenance cartridge 102 by logging drive commands sent to the actuator 406 or monitoring the electric drive signal. In another example, the actuator 406 may be equipped with a sensor providing feedback on the movement of the actuator, e.g. by monitoring a motor current or voltage, which the controller 408 may read out and use to track the position of the maintenance cartridge 102. The actuator also may include a position or rotation sensor, e.g. using Hall sensors or an encoder. In yet another example, the printing device 400 may comprise an encoder strip along the maintenance path 104, e.g. a strip with a barcode-like pattern or a periodic surface structure, that may be detected by a sensor of the maintenance cartridge 102 connected to the controller 408 to track the position of the maintenance cartridge 102.

The printing device 400 may further comprise end stops 410 and 412, which limit the maintenance path 104, e.g. parts of a frame or chassis of the printing device 400 or an enclosure of a print head maintenance assembly comprising the maintenance cartridge 102. To detect when the maintenance cartridge 102 reaches an end stop, the actuator 406 may be equipped with a sensor providing feedback on the movement of the actuator 406, e.g. by monitoring a motor current, a motor voltage, pulse-width modulation counts or encoder counts. The controller 408 may read out the feedback signal to detect when movement of the actuator is blocked, e.g. when the maintenance cartridge 102 bumps into one of the end stops 410, 412 and is prevented from moving further. This may also be used to detect when the maintenance cartridge 102 encounters an obstacle along the maintenance path 104. Alternatively, the end stops 410, 412 or the maintenance cartridge 102 may be equipped with a contact sensor that is connected to the controller 408 and detects when the maintenance cartridge 102 comes in contact with one of the end stops 410, 412.

In the example shown in FIG. 4, the maintenance cartridge 102 comprises a wiping subsystem 414 with two wipers 416 in order to wipe contaminants off the print head 402. The wipers 416 may e.g. be arranged on a top face of the maintenance cartridge 102 such that the wipers 416 can come in contact with a bottom face of the print head 402 when the print head 402 is placed above the maintenance cartridge 102 in the direction of view of FIG. 4.

If the position of the maintenance cartridge 102 or the print head 402 is unknown, e.g. when the printer is restarted, in particular after having crashed or having been serviced, moving the maintenance cartridge 102 or the print head 402 may be dangerous in certain configurations. For example, when the print head 402 is in contact with the wipers 416, moving the print head 402 in the Y-direction might damage the wipers 416. This can be prevented by first moving the maintenance cartridge 102 along the maintenance path, which may e.g. be the common wiping direction used for cleaning.

The maintenance cartridge 102 may comprise a warning flag 418 to indicate when the maintenance cartridge 102 is at a safe or an unsafe position, e.g. to indicate that the maintenance cartridge 102 should not be moved or to indicate whether to first move the print head 402 or the maintenance cartridge 102. The sensor 108 is to detect the warning flag 418 to determine whether the maintenance cartridge 102 is at a safe or an unsafe position. If the sensor 108 is an photoelectric sensor as described above, the warning flag 418 may e.g. be a protrusion on the maintenance cartridge that blocks the path between the light source 110 and the optical sensor element 112 whenever the maintenance cartridge 102 is at an unsafe position, e.g. when the wipers 416 are adjacent to the print head path 404. In another example, the warning flag 418 may be an elongated magnet or a series of magnets embedded in a side face of the maintenance cartridge 102 to be detected by a magnetic field sensor or an inductive sensor. As described in more detail below with reference to FIG. 8, the controller 408 may first read out the sensor signal from the sensor 108 before moving the maintenance cartridge 102 to determine whether it is safe to move the maintenance cartridge 102.

Figure 5:
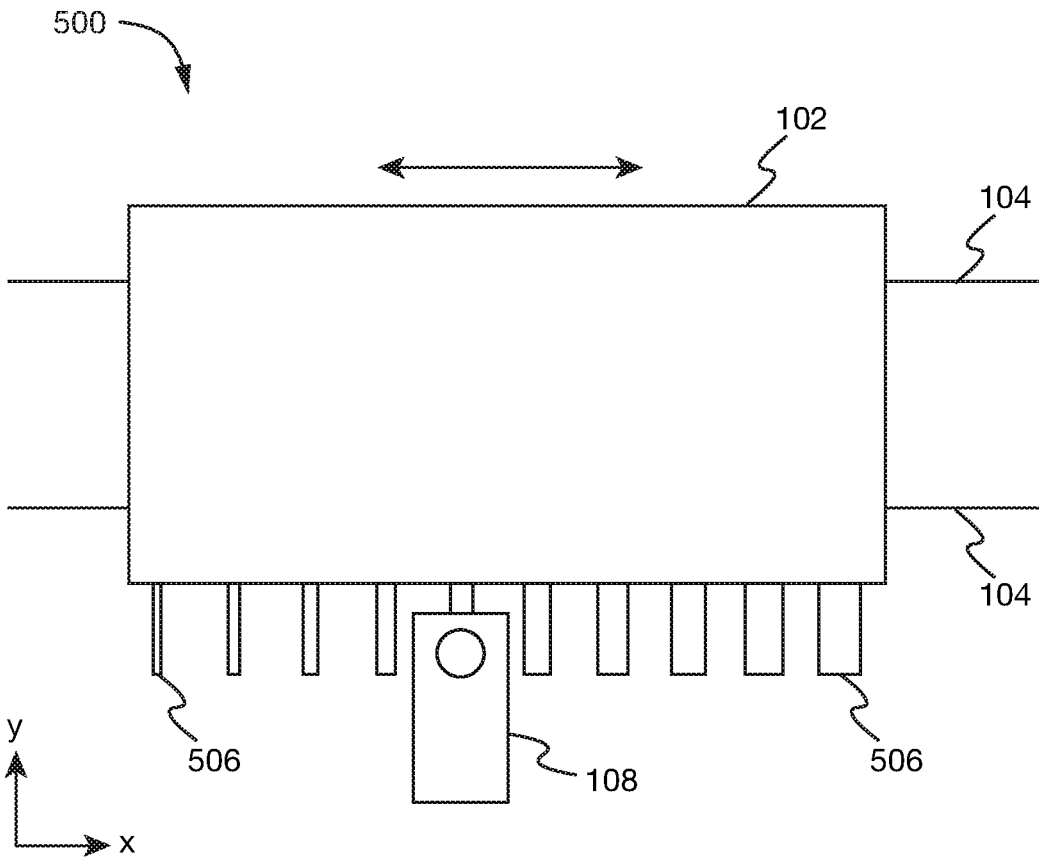
FIG. 5: a print head maintenance assembly with multiple positioning flags in accordance with an example in top view.

FIG. 5 depicts another example of a print head maintenance assembly 500 in top view. Similar to the print head maintenance assembly 100, the print head maintenance assembly 500 comprises a maintenance cartridge 102 movable along a maintenance path 104 and a sensor 108 to detect a positioning flag. Instead of the single positioning flag 106, the maintenance cartridge shown in FIG. 5 comprises a plurality of positioning flags 506, which may e.g. be distributed over a side face of the maintenance cartridge 102. Similar to the positioning flag 106, the positioning flags 506 can be adapted to the sensor 108 in order to be detected. The positioning flags 506 may e.g. be protrusions to be detected by a photoelectric sensor or metallic elements to be detected by a capacitive sensor. The positioning flags 506 may for example have different widths or visible lengths as defined above and/or may be arranged at varying distances in order to encode the position of the respective positioning flag 506 on the maintenance cartridge. In the example shown in FIG. 5, the width of the positioning flags 506 increases along the X-direction. This may facilitate a repeated referencing of the maintenance cartridge 102, e.g. by continuously detecting the positioning flags 506 during operation. For example, if the print head maintenance assembly 500 is part of a printing device, like the printing device 400, the controller 408 may determine the width of positioning flag 506 and/or the distance between neighboring positioning flags 506 by reading out the sensor signal 108 while moving the maintenance cartridge 102 and tracking the movement of the maintenance cartridge. Based on the measured width and/or distance, the controller 408 may determine the position of the maintenance cartridge 102.

Figure 6A:
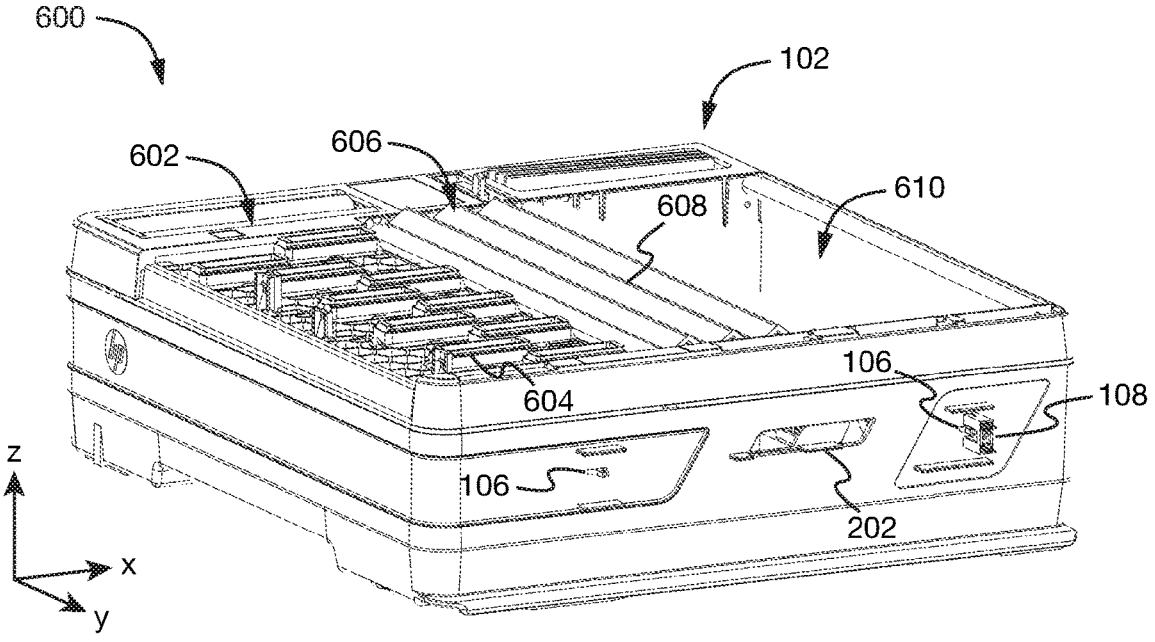
FIG. 6*a*: a print head maintenance assembly in accordance with an example in a perspective view.
Figure 6B:
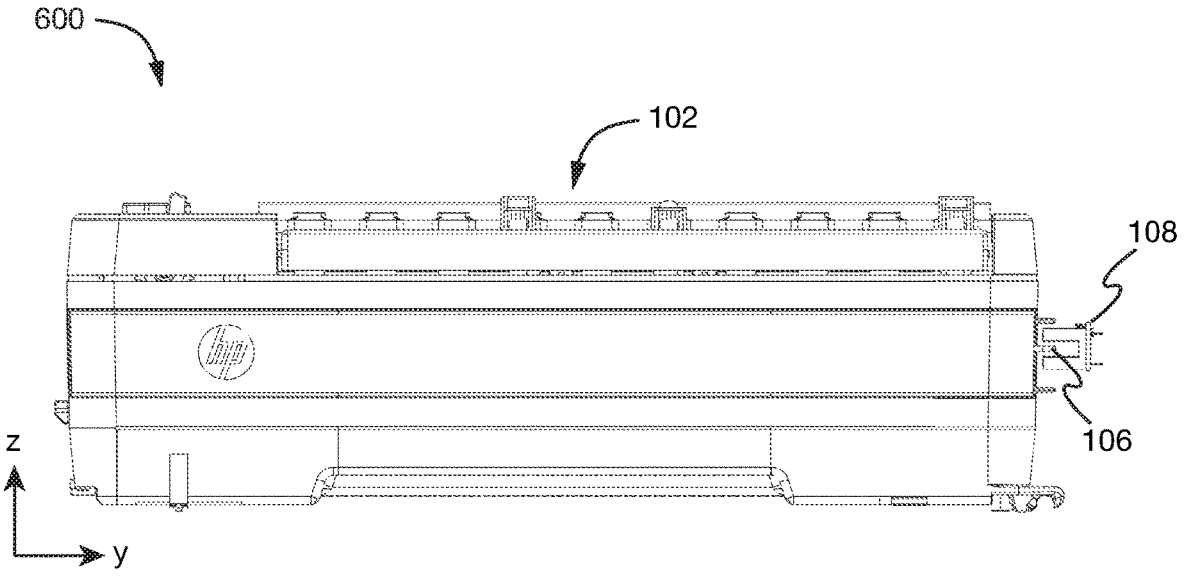
FIG. 6*b*: the print head maintenance assembly of FIG. 6*a* in front view.

FIGS. 6*a* and 6*b* illustrate another example of a print head maintenance assembly 600 in a perspective view and in front view, respectively. The print head maintenance assembly 600 comprises a maintenance cartridge 102 with three subsystems: a capping subsystem 602, a wiping subsystem 606 and a spittoon subsystem 610. The capping subsystem can comprise a plurality of caps 604, e.g. one cap for each nozzle plate of a print head. The caps 604 may e.g. be used to cover the nozzle plates of the print head during or after cleaning or when the printer is not in use to prevent evaporation of ink from the nozzles. The wiping subsystem 606 can comprise a plurality of wipers 606, which may e.g. press a wiping material passing over the wipers against the print head. For simplicity, a single cap and a single wiper are provided with reference signs in FIG. 6*a*. The spittoon subsystem 610 may comprise a number of waste tanks or spittoons (not shown in FIGS. 6*a* and 6*b*) for receiving material ejected from the print head, e.g. one reservoir for each nozzle plate or for each row of nozzles or for each array of nozzles of a particular color of the print head. Each of the reservoirs may comprise a spit roller, which is arranged at the respective reservoir, e.g. to transfer material ejected from the nozzles of the print head into the reservoirs.

On a side face of the maintenance cartridge 102, two positioning flags 106 are arranged, wherein the positioning flags 106 are protrusions extending outwards from the side face. The positioning flags 106 are arranged on the same height along the Z-direction as a "U"-shaped sensor 108 such that one of the positioning flags 106 is located between the legs of the sensor 108 when the maintenance cartridge 102 is in the respective reference position as illustrated in FIG. 6*b*. The sensor 108 may e.g. be a photoelectric sensor that is triggered by the one of the positioning flags 106 when the maintenance cartridge 102 is in the respective reference position.

In addition, the maintenance cartridge 102 comprises a status flag 202 arranged on the same side face of the maintenance cartridge 102 as the positioning flags 106. The status flag 202 also comprises a protrusion extending outwards from the side face to be detected by the sensor 108. The status flag 202 is arranged in a cutout in the side face such that the status flag 202 can be moved in the X-direction along the side face, e.g. to indicate the status of a web wipe in the wiping subsystem as described above with reference to FIGS. 2*a* and 2*b*.

Figure 7:
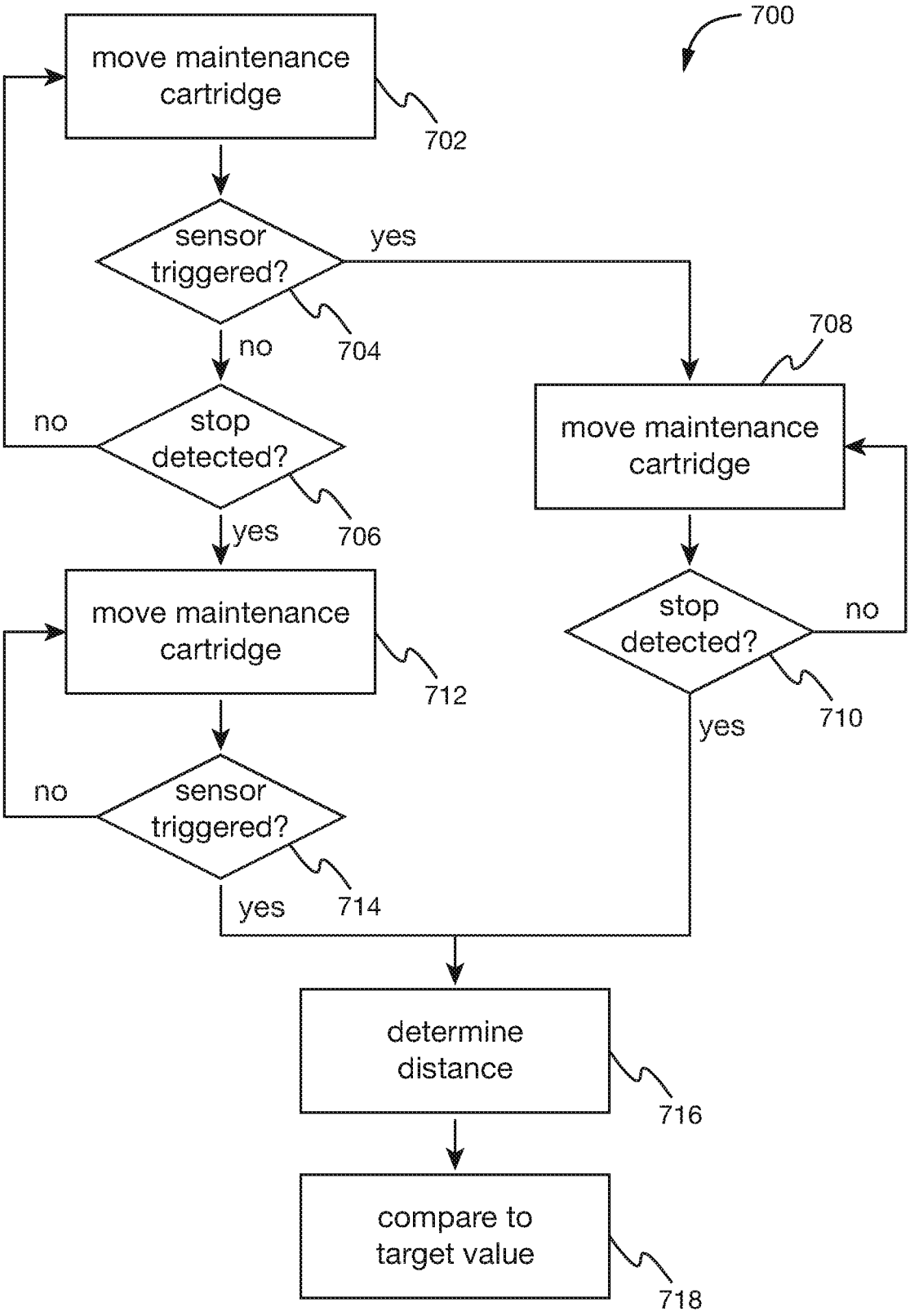
FIG. 7: a flow chart for an example of a method of controlling a print head maintenance assembly.

FIG. 7 shows a flow chart of a method 700 of controlling a print head maintenance assembly according to an example. The method 700 may for example be performed with the printing device 400 and will be described in the following with reference to FIG. 4. This is, however, not intended to be limiting in any way. The method 700 may be executed with any appropriate printing device or print head maintenance assembly comprising a maintenance cartridge having a positioning flag and a proximity sensor to detect the positioning flag, such as the print head maintenance assemblies 100, 200, 300, and 500. The proximity sensor may be any type of proximity sensor that detects the presence or absence of the positioning flag in the vicinity of the sensor, e.g. a photoelectric sensor or an electric or magnetic proximity sensor suitable for the positioning flag in use.

The method 700 may e.g. be executed as part of a startup procedure when the printing device 400 is switched on or at certain points in time during operation of the printing device 400. Initially, the position of the maintenance cartridge 102 along the maintenance path 104 may be unknown, e.g. since the maintenance cartridge 102 may have been moved manually while the printing device 400 was switched off, and the method 700 may be performed to determine the position of the maintenance cartridge 102. In other examples, the position of the maintenance cartridge 102 may be known approximately, e.g. by tracking the movement of the maintenance cartridge 102 during operation, and the method 700 may be performed to obtain a new reference for the position of the maintenance cartridge 102. The method 700 may further be used to determine whether the maintenance path 104 is free of obstacles, i.e. that the maintenance cartridge 102 can move between the end stops 410, 412 as expected.

In step 702, the maintenance cartridge 102 is moved along the maintenance path 104, e.g. using the actuator 406. Moving the maintenance cartridge 102 may comprise tracking the movement of the maintenance cartridge 102 to determine the distance moved by the maintenance cartridge, e.g. via the controller 408 as described above with reference to FIG. 4.

In 704, a check is performed whether the proximity sensor 108 is triggered by the positioning flag 106, e.g. by reading out the sensor signal via the controller 408 and determining from the sensor signal whether the positioning flag 106 is at the position of the proximity sensor 108. In one example, this may comprise monitoring the sensor signal, e.g. a voltage quantifying the light intensity at the optical sensor element 112, and determining whether the sensor signal is above or below a predefined trigger value. In other examples, the proximity sensor 108 may comprise an electronic circuit that determines if the proximity sensor 108 is triggered and sends a corresponding trigger signal to the controller 408.

When the proximity sensor 108 is triggered by the positioning flag 106, the maintenance cartridge 102 is at the reference position as defined above, i.e. the positioning flag 106 is at the position of the proximity sensor 108, and correspondingly the position of the maintenance cartridge 102 is known. In one example, if the purpose of method 700 is to determine the position of the maintenance cartridge, execution of the method 700 may be terminated at this point. If the proximity sensor 108 is not triggered, the method 700 may return to 702 and move the maintenance cartridge 102 again. This process may be repeated until the proximity sensor 108 is triggered. In 702, the maintenance cartridge 102 may be moved in one direction or may be moved back and forth along the maintenance path 104. For example, the maintenance cartridge 102 may be moved in one direction for a predefined distance or a predefined amount of time and if the proximity sensor 108 has not been triggered yet, the direction may be reversed.

The method 700 may further comprise determining, in 706, whether the maintenance cartridge 102 has encountered a mechanical stop blocking its movement along the maintenance path 104. The mechanical stop may be an expected mechanical stop, e.g. caused by the end stops 410 and 412, or may be an unexpected mechanical stop, e.g. if there is an obstacle along the maintenance path 104. The mechanical stop may e.g. be detected by the controller 408 reading out a feedback signal like a motor current or voltage from a sensor in the actuator 406 to determine whether the movement of the actuator is impeded or blocked. In another example, the maintenance cartridge 102 may be equipped with a contact sensor to detect a contact with the end stop 410, 412 or an obstacle. In yet another example, the printing device 400 may comprise an encoder strip along the maintenance path 104, e.g. a strip with a barcode-like pattern or a periodic surface structure, that may be detected by a sensor of the maintenance cartridge 102 connected to the controller 408 to track the position of the maintenance cartridge 102 and the controller 408 may determine whether there is a mismatch between an expected movement and an actual movement determined based on the encoder strip.

If neither the proximity sensor 108 is triggered nor a stop is detected in 706, the method 700 may return to 702 and move the maintenance cartridge 102 again as described above. This process may be repeated until the proximity sensor 108 is triggered or a stop is detected.

If the proximity sensor 108 is triggered by the positioning flag 106, the maintenance cartridge 102 is at the reference position as defined above and the method 700 may proceed to 708 in order to determine whether there are any unexpected obstacles along the maintenance path. In 708, the maintenance cartridge 102 is again moved along the maintenance path 104, e.g. using the actuator 406. The maintenance cartridge 102 may be moved in the same direction as in 702 or may be moved in the opposite direction. In 710, it again is determined whether the maintenance cartridge 102 has encountered a mechanical stop. If not, the method 700 returns to 708 to continue moving the maintenance cartridge 102, otherwise the method 700 proceeds to 716.

If a mechanical stop is detected in 706, the maintenance cartridge 102 has encountered an obstacle blocking its movement in its previous direction of movement, but the position of the maintenance cartridge 102 may still be unknown. To determine the position of the maintenance cartridge 102, the method may then proceed to 712 to move the maintenance cartridge 102 along the maintenance path again, wherein the maintenance cartridge 102 is moved in the direction opposite to its previous direction of movement, i.e. moving away from the obstacle. This movement is continued until the proximity sensor 108 is triggered by the positioning flag 106, i.e. the maintenance cartridge 102 has reached the reference position. When this is detected in 714, the method 700 proceeds to 716.

In 716, the distance is determined that the maintenance cartridge 102 has moved, in 708 or 712, between the reference position and a bump position, i.e. the position in which the mechanical stop was detected. This distance may for example be determined by tracking the position of the maintenance cartridge 102 as described above, e.g. by logging drive commands or an electric drive signal, monitoring the movement of the actuator via a feedback signal or detecting an encoder strip while moving the maintenance cartridge 102 in 708 or 712.

In 718, the distance moved by the maintenance cartridge 102 in 708 or 712 is compared to a predefined target value, e.g. a calibrated distance between the reference position and an expected bump position, e.g. a bump position in which the maintenance cartridge 102 has reached one of the end stops 410, 412. If the distance matches the target value, it can be assumed that the maintenance path 104 between the reference position and the expected bump position is free of obstacles. Otherwise, the printing device 400 may enter an error state, in which the printing device 400 may e.g. ask a user to manually check for and remove obstacles from the maintenance path 104.

The method 700 may be executed and modified in various ways. For example, after the distance between the reference position and the bump position has been determined, the method 700 may proceed by moving the maintenance cartridge 102 in the direction opposite to the direction of movement in which the mechanical stop was detected until another mechanical stop is detected, e.g. to determine whether the entire maintenance path 104 between the end stops 410, 412 is free of obstacles. Furthermore, the flow diagram shown in FIG. 7 does not imply a certain order of execution for the method 700. As far as technically feasible, the method 700 may be performed in any order and different parts may be performed simultaneously at least in part. For example, the tasks 702, 704, and 706 may be performed sequentially or simultaneously, i.e. while the maintenance cartridge 102 is moved in 702, it may be continuously checked whether the proximity sensor 108 is triggered or a mechanical stop has occurred.

Figure 8:
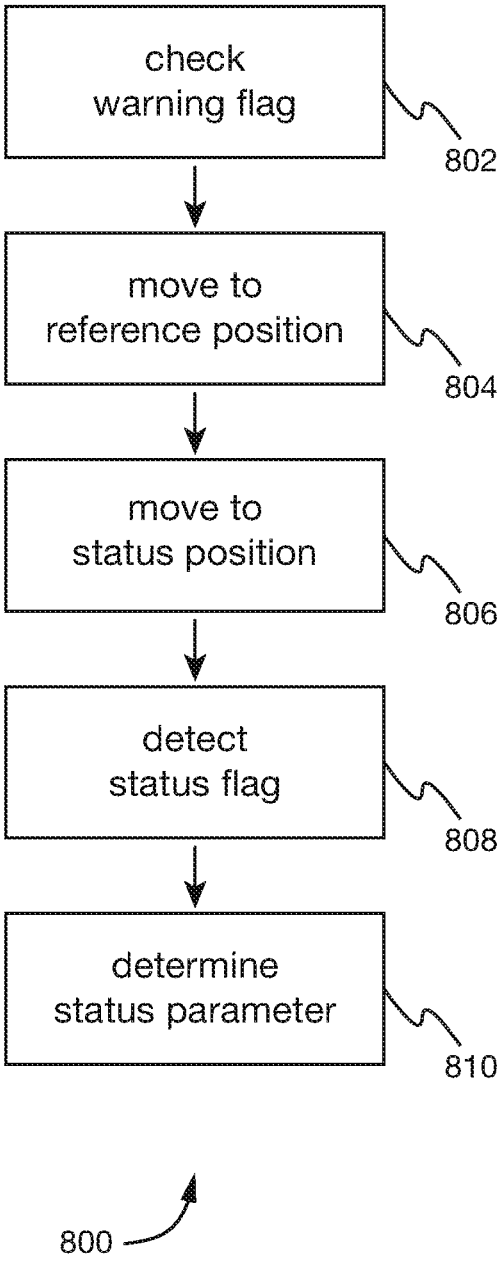
FIG. 8: a flow chart for another example of a method of controlling a print head maintenance assembly.

FIG. 8 depicts a flow chart for a method 800 of controlling a print head maintenance assembly according to another example. The method 800 may for example be performed with a printing device like the printing device 400 including a print head maintenance assembly and will be described in the following with reference to FIGS. 2, 3, and 4. This is, however, not intended to be limiting in any way. The method 800 may be executed with any appropriate printing device or print head maintenance assembly comprising a maintenance cartridge having a positioning flag, a warning flag and a status flag and a proximity sensor to detect these flags, e.g. a photoelectric sensor. The method 800 may for example be executed as part of a startup procedure when the printing device 400 is switched on or at certain points in time during operation of the printing device 400, e.g. to determine the position and a status of the maintenance cartridge.

The method 800 comprises determining, in 802, whether the proximity sensor 108 is triggered before moving the maintenance cartridge 102. The proximity sensor 108 may for example be triggered by the warning flag 418 of the maintenance cartridge 102, which may e.g. indicate that the maintenance cartridge 102 is in an unsafe position and that certain precautions have to be taken before moving the maintenance cartridge 102 or another element of the printing device 400, e.g. the print head 402. Accordingly, the method 800 may enter a failure mode to resolve an issue indicated by the warning flag 418 before proceeding further. In the failure mode, the printing device may e.g. perform movements that are safe until the unsafe condition has been cleared. In some examples, it may for example be an option to first move the maintenance cartridge 102 before moving the print head 402 or vice versa. In other examples, the warning flag 418 may trigger the proximity sensor 108 when the maintenance cartridge 102 is in a safe position and the method 800 may proceed as usual if the proximity sensor 108 is triggered. If the proximity sensor 108 is triggered, 802 may further comprise determining whether the proximity sensor 108 is triggered by the warning flag 418 or the positioning flag 106 or the status flag 202, 302. In one example, the proximity sensor 108 may be a photoelectric sensor and the warning flag 418 may be partially transparent, e.g. transmitting about 50% of the light emitted from the light source 110. The warning flag 418 can then be distinguished from the positioning flag 106 and the status flag 202, 302, which e.g. may be opaque, based on the light intensity measured by the optical sensor element 112.

In 804, the maintenance cartridge 102 is moved along the maintenance path 104 until the proximity sensor 108 is triggered by the positioning flag 106, indicating that the maintenance cartridge 102 is at the reference position. This may e.g. be done as in method 700 and may also comprise checking for obstacles along the maintenance path 104 as described above.

In 806, the maintenance cartridge 102 is moved along the maintenance path 104 until the maintenance cartridge 102 is at a status position, at which the status flag 202, 302 can be detected by the proximity sensor 108. This may e.g. comprise moving the maintenance cartridge 102 until the proximity sensor 108 is triggered by the status flag 202, 302. In another example, the maintenance cartridge 102 may be at the reference position or at a known bump position at the end of 804 and may be moved by a calibrated distance from the respective position to the status position.

In 808, the status flag 202, 302 is detected by the proximity sensor 108. For a status flag indicating a status parameter by its position, like the status flag 202, this may comprise detecting that the proximity sensor 108 is triggered by the status flag 202. For a status flag indicating a status parameter through a visible length, like the status flag 302, this may comprise determining the visible length of the status flag 302, e.g. be determining the distance by which the maintenance cartridge is moved between the first and last positions at which the proximity sensor 108 is triggered by the status flag 302, e.g. the first and last positions at which the status flag 302 blocks the path between the light source 110 and the optical sensor element 112. In another example, the visible length of the status flag 302 may be determined from the light intensity measured at the optical sensor element 112, e.g. if the status flag 302 blocks a fraction of the light from the light source 110 that depends on the visible length. In yet another example, the status flag may be a magnetic element, whose distance from a side face of the maintenance cartridge 102 indicates a status parameter, and the proximity sensor 108 may be a magnetic field sensor that measures the strength of a magnetic field at the status position.

In 810, the status parameter of the maintenance cartridge 102 indicated by the status flag is determined based on a signal generated by the proximity sensor 108. If the status flag indicates the status parameter by its position like the status flag 202, this may e.g. comprise determining the distance between the reference position and the position at which the proximity sensor 108 is triggered by the status flag 202, wherein the distance may be determined from the distance moved by the maintenance cartridge 102 as described above. From this distance, the position of the status flag 202 on the maintenance cartridge 102 may be inferred to determine the status parameter, e.g. using a calibrated look-up table or a calibrated functional dependence between the status parameter and the position of the status flag 202. If the status flag indicates the status parameter through a visible length, like the status flag 302, and the visible length is determined in 808 when detecting the status flag, the status parameter may be determined based on the visible length, e.g. using a calibrated look-up table or a calibrated functional dependence between the status parameter and the visible length. If the status flag is a magnetic element as described above, the status parameter may e.g. be extracted from the magnetic field strength measured by the proximity sensor 108 in 808.

The method 800 may be executed and modified in various ways. The flow diagram shown in FIG. 8 does not imply a certain order of execution for the method 800. As far as technically feasible, the method 800 may be performed in any order and different parts may be performed simultaneously at least in part. Some parts of the method 800 may be omitted, e.g. depending on the type of maintenance cartridge used or depending at which time the method 800 is performed. In one example, the method 800 may be executed completely during startup of the printing device 400, whereas the method 800 may be executed without checking the warning flag 418 in 802 at some point during operation of the printing device 400. In another example, the parts 806, 808 and 810 may be executed to determine the status parameter during operation of the printing device 400, without executing other parts.

This description is not intended to be exhaustive or limiting to any of the examples described above. The print head maintenance assembly, printing device and method disclosed herein can be implemented in various ways and with many modifications without altering the underlying basic properties.

The invention claimed is:

1. A print head maintenance assembly, the print head maintenance assembly comprising:

a maintenance cartridge comprising a positioning flag, wherein the maintenance cartridge and the positioning flag are movable along a maintenance path as the maintenance cartridge cleans a print head of a printing device; and a sensor to detect the positioning flag and generate a sensor signal indicating a distance between the sensor and the positioning flag, wherein a controller of the printing device receives the sensor signal from the sensor and determines a position of the maintenance cartridge along the maintenance path relative to an axis of the printing device based on the sensor signal.

2. The print head maintenance assembly of claim 1, wherein the positioning flag is a protrusion arranged on a side face of the maintenance cartridge.

3. The print head maintenance assembly of claim 2, wherein the sensor is a photoelectric sensor and the positioning flag triggers the photoelectric sensor when the maintenance cartridge is in a reference position.

4. The print head maintenance assembly of claim 1, wherein the maintenance cartridge further comprises a status flag to indicate a status parameter of the maintenance cartridge; and the sensor is to detect the status flag to determine e status parameter of the maintenance cartridge.

5. The print head maintenance assembly of claim 4, wherein the maintenance cartridge further comprises a spittoon to receive material ejected from the print head and the status parameter characterizes a filling level of the spittoon.

6. The print head maintenance assembly of claim 4, wherein the maintenance cartridge further comprises a web wipe to wipe the print head and the status parameter characterizes a usage status of the web wipe.

7. The print head maintenance assembly of claim 4, wherein the status flag is a protrusion on a side face of the maintenance cartridge wherein the status flag is to change a position of the status flag on the side face with a status change or to increase or decrease a visible length of the status flag outside the maintenance cartridge with the status change.

8. The print head maintenance assembly of claim 1, wherein the maintenance cartridge further comprises a number of additional positioning flags having at least one of varying widths or distances to encode a number of positions along a length of the maintenance cartridge.

9. The print head maintenance assembly of claim 1, wherein the maintenance cartridge further comprises a warning flag to indicate that the maintenance cartridge is at a safe or unsafe position; and the sensor is to detect the warning flag to determine whether the maintenance cartridge is at the safe or unsafe position.

10. A printing device comprising:

a print head, wherein the print head is movable along a print head path in a scanning direction;

a maintenance cartridge comprising a positioning flag, wherein the maintenance cartridge and the positioning flag are movable along a maintenance path to clean the print head;

a sensor to detect the positioning flag and generate a sensor signal indicating a distance between the sensor and the positioning flag;

an actuator to move the maintenance cartridge along the maintenance path; and a controller to control the actuator to move the maintenance cartridge, receive the sensor signal from the sensor, and determine a position of the maintenance cartridge along the maintenance path relative to an axis of the printing device based on the sensor signal.

11. The printing device of claim 10, wherein the controller tracks the position of the maintenance cartridge by determining a distance that the maintenance cartridge moves after the controller has determined the position of the maintenance cartridge from the sensor signal.

12. The printing device of claim 10, further comprising a number of additional positioning flags having at least one of varying widths or distances to encode a number of positions along a length of the maintenance cartridge.

13. The printing device of claim 10, wherein the maintenance cartridge further comprises a warning flag to indicate that the maintenance cartridge is at a safe or unsafe position; and the sensor is to detect the warning flag to determine whether the maintenance cartridge is at the safe or unsafe position.

14. A method of controlling a print head maintenance assembly in a printing device, the print head maintenance assembly comprising:

a maintenance cartridge having a positioning flag, wherein the maintenance cartridge and the positioning flag are movable along a maintenance path to clean a print head of the printing device; and a sensor to detect the positioning flag;

the method comprising:

moving the maintenance cartridge along the maintenance path until the sensor is triggered by the positioning flag;

receiving, by a controller, a sensor signal from the sensor indicating a distance between the sensor and the positioning flag; and determining, by the controller, a position of the maintenance cartridge along the maintenance path relative to an axis of the printing device based on the sensor signal.

15. The method of claim 14, further comprising:

moving the maintenance cartridge along the maintenance path until a mechanical stop is detected at a bump position;

determining a distance moved by the maintenance cartridge between a reference position and the bump position; and comparing the distance moved by the maintenance cartridge to a predefined target value to determine whether the maintenance cartridge has reached an end point of the maintenance path or the maintenance cartridge has met an obstacle along the maintenance path.

16. The method of claim 12, wherein the maintenance cartridge further comprises a status flag;

the method further comprising:

moving the maintenance cartridge along the maintenance path until the maintenance cartridge is at a status position;

detecting the status flag by the sensor; and determining a status parameter of the maintenance cartridge based on a status signal generated by the sensor.

17. The method of claim 12, wherein the maintenance cartridge further comprises a warning flag to indicate that the maintenance cartridge is at a safe or unsafe position; and the sensor is triggered by the warning flag when the maintenance cartridge is at 114 the safe or unsafe position, respectively;

the method further comprising:

determining whether the sensor is triggered before moving the maintenance cartridge along the maintenance path.

18. The method of claim 14, wherein the maintenance cartridge further comprises a number of additional positioning flags having at least one of varying widths or distances to encode a number of positions along a length of the maintenance cartridge.

19. The method of claim 14, wherein the maintenance cartridge further comprises a warning flag to indicate that the maintenance cartridge is at a safe or unsafe position; and the method further comprising:

detecting, by the sensor, the warning flag to determine whether the maintenance cartridge is at the safe or unsafe position.

* * * * *